US009650848B2

(12) United States Patent
Taylor et al.

(10) Patent No.: US 9,650,848 B2
(45) Date of Patent: May 16, 2017

(54) FLEXIBLE CONTACTS FOR USE IN OIL AND GAS APPLICATIONS

(71) Applicant: Sabritec, Irvine, CA (US)

(72) Inventors: Ronald Taylor, Spring, TX (US); Richard Johannes, Trabuco Canyon, CA (US); Michael Carlson, Huntington Beach, CA (US)

(73) Assignee: SABRITEC, Costa Mesa, CA (US)

( * ) Notice: Subject to any disclaimer, the term of this patent is extended or adjusted under 35 U.S.C. 154(b) by 13 days.

(21) Appl. No.: 14/731,066

(22) Filed: Jun. 4, 2015

(65) Prior Publication Data

US 2016/0322739 A1 Nov. 3, 2016

Related U.S. Application Data

(60) Provisional application No. 62/156,074, filed on May 1, 2015.

(51) Int. Cl.

| | |
|---|---|
| ***H01R 13/52*** | (2006.01) |
| ***E21B 17/20*** | (2006.01) |
| ***H01R 13/17*** | (2006.01) |
| ***H01R 13/533*** | (2006.01) |
| ***H01R 24/86*** | (2011.01) |
| *H01R 13/33* | (2006.01) |

(52) U.S. Cl.

CPC ..... *E21B 17/20* (2013.01); *H01R 13/17* (2013.01); *H01R 13/521* (2013.01); *H01R 13/533* (2013.01); *H01R 24/86* (2013.01); *H01R 13/33* (2013.01)

(58) Field of Classification Search

CPC H01R 13/5202; H01R 13/52; H01R 13/5219; H01R 33/965

USPC ..... 439/271, 587, 843, 851

See application file for complete search history.

(56) References Cited

U.S. PATENT DOCUMENTS

| | | | | |
|---|---|---|---|---|
| 6,471,555 | B2 * | 10/2002 | Creze | H01R 13/187 439/841 |
| 6,520,998 | B1 * | 2/2003 | Scholler | H01R 13/187 439/843 |
| 6,805,594 | B2 * | 10/2004 | LaCoy | H01R 13/33 439/851 |
| 7,249,971 | B2 * | 7/2007 | Burke | B29C 45/14639 439/589 |
| 7,311,566 | B2 * | 12/2007 | Dent | H01R 13/187 439/63 |
| 7,946,892 | B2 * | 5/2011 | Carboni | H01R 13/2421 439/660 |
| 8,267,707 | B2 * | 9/2012 | Rogers | H01R 13/52 439/271 |
| 8,992,243 | B2 * | 3/2015 | Cameron | H01R 13/5202 439/271 |
| 2013/0189867 | A1 * | 7/2013 | Cameron | H01R 13/5202 439/271 |
| 2015/0311639 | A1 * | 10/2015 | Neureiter | B60K 1/00 310/71 |

* cited by examiner

*Primary Examiner* — Hae Moon Hyeon
(74) *Attorney, Agent, or Firm* — Snell & Wilmer L.L.P.

(57) ABSTRACT

Electrical contacts for use in oil and gas applications that include at least one elongate contact element defining a cavity for receiving a male electrical contact. The at least one elongate contact element may be configured to flex away from the cavity. Such electrical contacts may be used in electrical connectors, including contact blocks and electrical contact kits.

13 Claims, 13 Drawing Sheets

FLEXIBLE CONTACTS FOR USE IN OIL AND GAS APPLICATIONS

CROSS REFERENCE TO RELATED APPLICATIONS

This application claims the benefit of U.S. Provisional Application No. 62/156,074, filed May 1, 2015, the entire contents of which are herein incorporated by reference.

BACKGROUND

Downhole tools used in oil and gas applications are exposed to hostile environments. Such tools may be exposed to wide temperature variations, ranging from below freezing surface temperatures to very high temperatures found beneath the surface of the earth. In addition, high fluid pressure, in the form of gas or liquid pressure found beneath the earth may be exerted upon such tools. Caustic chemicals may also contact such tools, serving to damage or corrode them.

The sophistication of such tools has increased. Tools that once simply bored a hole straight down into the earth are being replaced with tools capable of a wide variety of bore patterns, capable of extending for long horizontal distances. Many tools are now guided or navigated via a computer present at the drilling site. Accordingly, the number of electrical connections to such downhole tools has also increased. The electronics and electrical connections present on the downhole tools are often exposed to the same hostile conditions as the tools themselves.

Prior existing electrical connectors for downhole tools suffer from a series of drawbacks including lack of resistance to thermal stress relaxation and shock and vibration. Prior electrical connectors may be damaged, or may become disconnected altogether, which may result in loss of signal or power to the downhole tool. A loss of signal or power could cripple a drilling operation.

SUMMARY

The electrical connectors, including contact blocks and electrical contact kits disclosed herein are intended to address the deficiencies found to exist in prior electrical connectors for downhole tools. The embodiments disclosed herein utilize electrical contacts that include at least one elongate contact element defining a cavity for receiving a male electrical contact and configured to flex away from the cavity. Such electrical contacts, particularly used in oil and gas applications, have been found to beneficially improve the resistance of the electrical connector to thermal stress relaxation and shock and vibration.

In one embodiment, an electrical connector may be configured to seal a differential pressure across a bulkhead. The electrical connector may include a connector body having a first end and a second end and a length therebetween and an exterior surface.

The connector body may be configured to be positioned in a port of the bulkhead. A first electrical contact may be positioned at the first end of the connector body. A second electrical contact may be positioned at the second end of the connector body and may include at least one elongate contact element defining a cavity for receiving a male electrical contact and configured to flex away from the cavity.

A conductor pin may extend through the connector body along the length of the connector body and may electrically connect the first electrical contact to the second electrical contact. The connector body may have a sealed connection to at least one of the first electrical contact, the second electrical contact, or the conductor pin, for sealing a pressure differential across the bulkhead.

In one embodiment, an electrical contact kit may be configured to form a sealed connection with a mating connector having a male electrical contact. The electrical contact kit may include an electrical contact having a first end and a second end that extends axially posterior relative to the first end. The electrical contact may include at least one elongate contact element defining a cavity for receiving the male electrical contact and configured to flex away from the cavity. The second end of the electrical contact may be configured to electrically connect with a wire.

A rubber shroud may be configured to extend over the electrical contact from the first end to the second end of the electrical contact. The rubber shroud may include a posterior portion and an anterior portion, the posterior portion configured to extend axially posterior from the second end of the electrical contact and include a cavity for the wire to pass through when the rubber shroud extends over the electrical contact. The anterior portion may be configured to protrude axially anterior from the first end of the electrical contact when the rubber shroud extends over the electrical contact and to extend over a portion of the mating connector to form a sealed connection with the mating connector.

In one embodiment, an electrical contact block may comprise a body and an electrical contact positioned in the body. The body may have an anterior face and a posterior face and a length therebetween and an exterior surface. The anterior face may include an opening and the posterior face may include an opening.

The electrical contact positioned in the body may include at least one elongate contact element defining a cavity for receiving a male electrical contact and configured to flex away from the cavity. The electrical contact positioned in the body may include a rear tail electrically connected to the plurality of elongate contact elements and extending through the opening of the posterior face for electrical connection to an electrical contact.

BRIEF DESCRIPTION OF THE DRAWINGS

Features and advantages of the systems, apparatuses, and methods as disclosed herein will become appreciated as the same become better understood with reference to the specification, claims, and appended drawings wherein:

DETAILED DESCRIPTION

Figure 1:
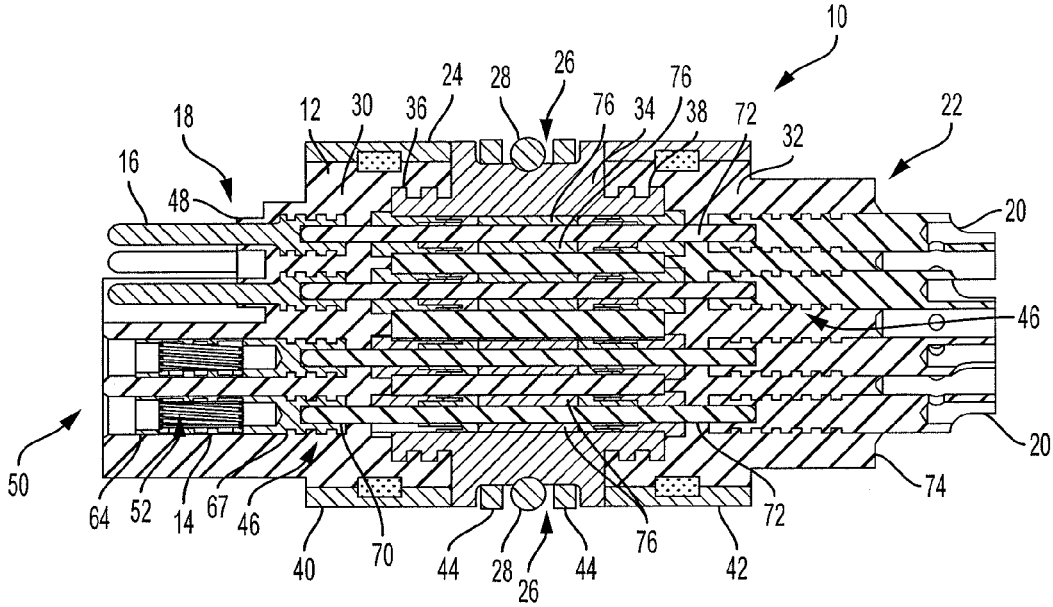
FIG. 1 illustrates a side cross sectional view of an electrical connector, according to an embodiment of the present disclosure.

FIG. 1 illustrates a side cross sectional view of an electrical connector 10 for use in oil and gas applications, for instance, for use with downhole tools. The electrical connector 10 is configured to seal a differential pressure across a bulkhead, which may be a component of a downhole tool, such that a hermetic seal is formed across the bulkhead. The electrical connector 10 may include a connector body 12 and a plurality of electrical contacts 14, 16 positioned at an anterior end 18 of the connector body 12. The electrical connector 10 may include a plurality of electrical contacts 20 positioned at a posterior end 22 of the connector body 12.

The connector body 12 may include an exterior surface 24 that extends from the anterior end 18 of the connector body 12 to the posterior end 22 of the connector body 12. The connector body 12 may have a length between the anterior end 18 and the posterior end 22 of the connector body 12. The connector body 12 may extend in an axial direction from the anterior end 18 to the posterior end 22. The exterior surface 24 may include a stepped structure such that the connector body 12 has different diameters at different points of the body 12. For example, as shown in FIG. 1, the middle of the connector body 12 has a larger diameter than the diameter of the connector body 12 at the anterior end 18 and the diameter at the posterior end 22. In other embodiments, a variety of diameters may be used for portions of the connector body 12.

The exterior surface 24 may include a groove 26 that extends circumferentially around the connector body 12. A sealing device such as an o-ring 28 may be positioned in the groove 26. The o-ring 28 may serve to contact a port of a structure that the connector body 12 is inserted into, for example, a bulkhead. The contact between the o-ring 28 and the port may serve to seal a pressure differential across the structure. In other embodiments, other forms of sealing devices may be used, including a washer, or other resilient or non-resilient gaskets.

The connector body 12 may include a single integral structure or multiple structures that are connected together. The connector body 12 is preferably constructed to seal a pressure differential across a structure that the connector body 12 is inserted into, for example, a bulkhead. The connector body 12, as shown in FIG. 1, may include an anterior portion 30, a posterior portion 32, and a central portion 34. The anterior portion 30 is connected to the central portion 34 by a suitable means, for example, by being overmolded or mechanically joined to a portion of the central portion 34. The anterior portion 30 for example may be overmolded over a protruding portion 36 of the central portion 34, with the protruding portion 36 including grooves for enhancing the bond between the anterior and central portion 34. The posterior portion 32 may similarly be overmolded over a protruding portion 38 of the central portion, with the protruding portion 38 similarly including grooves.

An anterior jacket 40 and a posterior jacket 42 may be positioned around anterior 30 and posterior portions 32 of the connector body 12, respectively. The jackets 40, 42 may serve to strengthen the connector body 12. The jackets 40, 42 may be made of a different material than the anterior 30 and posterior portions 32 to strengthen the connector body 12. For example, in one embodiment, the jackets 40, 42 may be made of a metallic material, whereas the anterior 30 and posterior 32 portions may be made of a plastic material such as a thermoplastic or the like. In one embodiment, the central portion 34 may be made of a metallic material. The portions and jackets of the connector body 12 may be connected to each other in a manner that seals a pressure differential across a structure that the connector body 12 is inserted into, for example, a bulkhead.

One or more back-up rings 44 may be positioned around the central portion 34. The back-up rings 44 may extend circumferentially around the exterior surface of the central portion 34, and may be positioned adjacent and on either side of the sealing device such as an o-ring 28. The back-up rings 44 may be configured to block movement of the sealing device when the connector 10 is in use under high pressure, to prevent the sealing device from being dislocated from the groove 26 due to the pressure. In one embodiment, the back-up rings 44 may be made of a plastic material such as a thermoplastic or the like. In other embodiments, other suitable materials may be utilized.

The connector body 12 may include cavities 46 that extend axially through the connector body 12. The cavities 46 receive electrical contacts 14, 16 that are positioned at the anterior end 18 of the connector body 12, and receive the respective electrical contacts 20 that are positioned at the posterior end 22 of the connector body 12.

The electrical contacts 16 comprise male pins that protrude from the anterior face 48 of the connector body 12. A portion of one of the electrical contacts 16 may be positioned in a cavity 46 of the connector body 12. The portion of the electrical contact 16 may include grooves that allow the anterior portion 30 of the body 12 to more easily connect to the electrical contact 16, through overmolding or the like.

The electrical contacts 14 comprise female contacts that may receive male electrical contacts through respective openings 50 in the anterior face 48 of the connector body 12. The electrical contacts 14 may be configured to include at least one elongate contact element defining a cavity for receiving a male electrical contact. The at least one elongate contact element may be configured to flex away from the cavity to accommodate the male electrical contact. In one embodiment, the at least one elongate contact element may be a plurality of elongate contact elements. The elongate contact elements may be positioned in a hyperboloid configuration.

Figure 2:
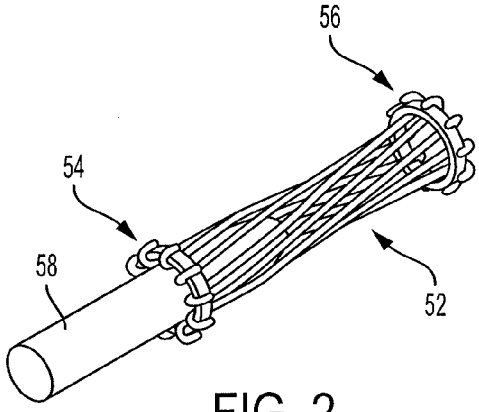
FIG. 2 illustrates a perspective view of a plurality of elongate contact elements positioned in a hyperboloid configuration for receiving a male electrical contact, according to an embodiment of the present disclosure.

FIG. 2 illustrates a plurality of elongate contact elements, in the form of wires 52, positioned in a hyperboloid configuration for receiving a male electrical contact, in a manner for use in the electrical contacts 14. The plurality of wires 52 extend between anterior ends 54 and posterior ends 56 of the wires 52. The anterior ends of each wire are spaced generally equal from each other to form a circular circumference. Similarly, the posterior ends of each wire are spaced generally equal from each other to form a circular circumference. The anterior and posterior end of each wire, however, is displaced angularly from one another around the respective circumference. The displacement of each of the wires 52 causes the wires 52 to have a hyperboloid configuration in that a cavity 60 (marked in FIG. 3) formed by the wires 52 for receiving the male contact 58 reduces in diameter, and may form a minimum at a middle of the axial length of the wires 52.

The plurality of wires 52 are each preferably flexible, such that the diameter of the cavity 60 at the middle of the axial length of the wires 52 expands as the male contact 58 is inserted therein. The plurality of wires 52 flex away from the cavity 60 as the male contact 58 is inserted therein. The plurality of wires may be resilient such that the wires 52 move towards their original position upon the male contact 58 being withdrawn from the cavity 60. The resiliency of the wires 52 may apply a force against the outer surface of the male contact 58 to enhance the electrical connection between the wires 52 and the male contact 58. As the male contact 58 is withdrawn, the wires 52 may return to a more narrow diameter for the cavity 60.

Figure 3:
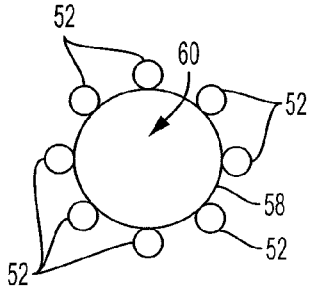
FIG. 3 illustrates a cross sectional view of a male contact positioned in a cavity formed by elongate contact elements, according to an embodiment of the present disclosure.

FIG. 3 illustrates a cross sectional view of the male contact 58 positioned in the cavity 60 formed by the wires 52.

Figure 4:
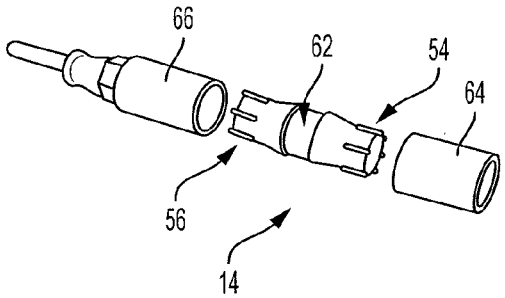
FIG. 4 illustrates a perspective view of an electrical contact for use in an electrical connector, according to an embodiment of the present disclosure.

FIG. 4 illustrates a perspective view of an embodiment of an electrical contact 14 for use in the electrical connector 10. The electrical contact 14 includes therein the plurality of wires 52 positioned in the hyperboloid configuration. The electrical contact 14 may include a central tube 62, a forward ring 64, and a rear tail 66.

The central tube 62 may include an interior cavity for containing the plurality of wires 52. The respective ends 54, 56 of the wires 52 may be bent over the ends of the central tube 62, as shown in FIG. 4, to connect the wires 52 to the central tube 62. The forward ring 64 may include a cavity for the male contact 58 to pass through to enter the cavity 60. The forward ring 64 may extend over the central tube 62 and the wires 52 at the anterior end 54 of the wires to secure the wires 52 in the hyperboloid configuration.

The rear tail 66 may include a cavity to allow the central tube 62 to be inserted therein. The rear tail 66 may extend over the central tube 62 and the wires 52 at the posterior end 56 of the wires to secure the wires 52 in the hyperboloid configuration. The rear tail 66 may be electrically connected to the wires 52 such that an electrical signal or power from the male contact 58 may be transmitted to the rear tail 66.

The structure of the rear tail 66 may be modified according to a particular application for the electrical contact 14. Referring back to FIG. 1, in an embodiment in which an electrical connector 10 is configured to seal a differential pressure across a bulkhead, the rear tail may be structured as rear tail 67 and may have a posterior portion that includes a cavity 70 for receiving a conductor pin 72 of the electrical connector 10. The rear tail 67 may also include grooves that allow the anterior portion 30 of the body 12 to more easily connect to the rear tail 67, through overmolding or the like. In one embodiment, the rear tail may be configured as a male pin, a solder cup, a crimp barrel, an eyelet, or the like.

The electrical contacts 20 comprise female electrical contacts in the form of solder cups that protrude from the posterior face 74 of the connector body 12. A portion of one of the electrical contacts 20 may be positioned in a cavity 46 of the connector body 12. The portion of the electrical contact 20 may include grooves that allow the posterior portion 32 of the body 12 to more easily connect to the electrical contact 20, through overmolding or the like.

A plurality of conductor pins 72 may extend through the connector body 12 along a length of the connector body 12. Each pin 72 may electrically connect an electrical contact at the anterior end 18 of the connector body 12 to a respective electrical contact at the posterior end 22 of the connector body 12. Accordingly, an electrical signal or electrical power may be passed from an electrical contact at the anterior end 18 of the connector body 12 to a respective electrical contact at the posterior end 22 of the connector body 12.

Each of the electrical contacts 14, 16, 20 may include a suitable structure to electrically connect to a respective conductor pin 72. As shown in FIG. 1, for example, the electrical contacts 14, 16, 20 may each include a cavity 70 for receiving one of the conductor pins 72.

The connector body 12 may have a sealed connection to each of the conductor pins 72 to seal a pressure differential across a structure that the connector body 12 is inserted into, for example, a bulkhead. A seal 76 may be positioned between the connector body 12 and a respective connector pin 72. The seal 76 may prevent gas and liquid pressure from passing through the connector body 12, to seal the pressure differential. The seal 76 may be constructed of an insulating material such as a glass or brazed ceramic, for example, in an embodiment in which the central portion 34 is made of a conductive material such as a metal. The insulating material of the seal 76 may prevent current from passing to the central portion 34. The connector body 12 may have a sealed connection to any of the electrical contacts 14, 16, 20 as well. The sealed connection to the electrical contacts 14, 16, 20 may be formed by overmolding the connector body 12 upon a portion of the electrical contacts 14, 16, 20.

Figure 5:
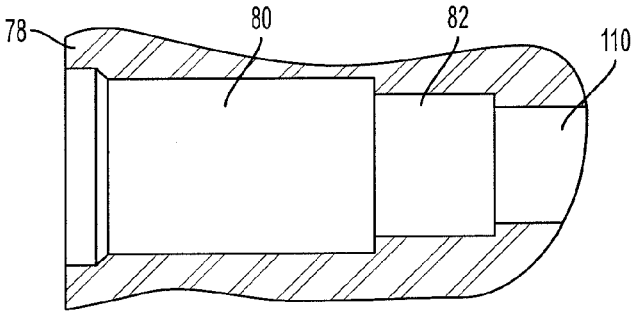
FIG. 5 illustrates a cross sectional view of a bulkhead, according to an embodiment of the present disclosure.

The electrical connector 10 is configured to seal a differential pressure across a bulkhead 78 as shown in FIG. 5. The electrical connector 10 may be positioned within the port 80 shown in FIG. 5 and may seal a pressure differential across the bulkhead 78. The posterior portion 32 of the electrical connector 10 may extend into a secondary cavity 82 of the bulkhead 78. The stepped structure of the connector body 12 may allow the electrical connector 10 to form fit both the port 80 and the secondary cavity 82.

Figure 6:
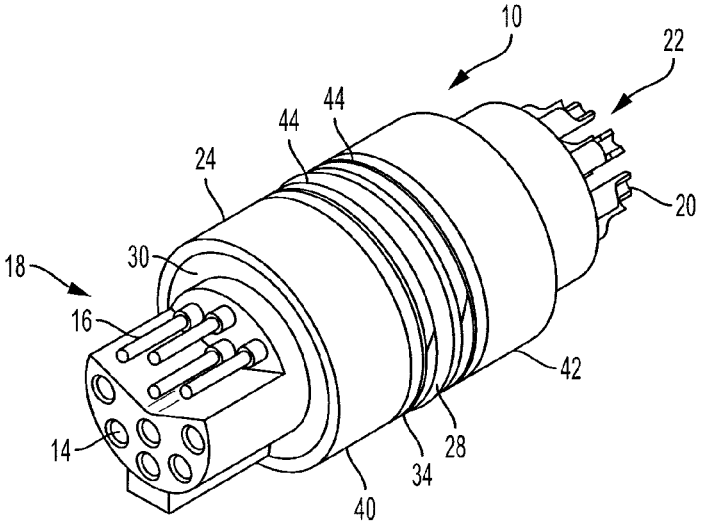
FIG. 6 illustrates a side perspective view of the electrical connector shown in FIG. 1.

FIG. 6 illustrates a side perspective view of the electrical connector 10.

In an embodiment in which the bulkhead 78 and electrical connector 10 are used in downhole tools for oil and gas, the pressure differential across the bulkhead 78 may be great. The anterior portion 30 of the electrical connector 10 may be on a high pressure side of the bulkhead 78, and the posterior portion 32 of the electrical connector 10 may be on a relatively low pressure side of the bulkhead 78.

The use of the electrical contacts 14 including the at least one elongate contact element defining a cavity for receiving a male electrical contact beneficially improves the resistance of the electrical connector 10 to thermal stress relaxation and shock and vibration. The at least one elongate contact element is flexible and configured to flex away from the cavity to accommodate the male electrical contact. The at least one elongate contact element may be resilient and structured to apply a force to a male contact that is inserted into the cavity. The at least one elongate contact element may maintain a connection to the male contact even though the male contact may have a different coefficient of thermal expansion than the elongate contact elements. For instance, as the male contact decreases in size, the at least one elongate contact element may maintain in contact with the male contact, due to its bias force against the contact. As the male contact increases in size, the at least one elongate contact element may maintain in contact with the male contact, due to its ability to vary in orientation. This provides an unexpected benefit over prior oil and gas connectors, which often lose electrical contact, or cause damage to the connector upon varied high and low temperatures. In addition, the complexity in matching the different coefficient of thermal expansions of the different components of the connectors is reduced.

In addition, the resilient nature of the at least one elongate contact element protects against loss of signal or damage due to shock and vibration. The bias force of the at least one elongate contact element may act as a dampener to shock and vibration, and causes the at least one elongate contact element to remain in contact with the male contact under heavy shock which may occur during drilling operations, for example. This provides an unexpected benefit over prior oil and gas connectors, which often have the male electrical contact become dislodged under heavy shock or vibration conditions.

Further, the electrical contacts 14 provide these unexpected benefits in light of a movement in the oil and gas connector field to reduce the number of parts. The at least one elongate contact element may provide an efficient method of addressing thermal stress relaxation and shock and vibration. Additional benefits include a lower insertion and extraction force for the corresponding male electrical contacts, and less overall electrical contact resistance for the electrical contact 14.

Figure 7:
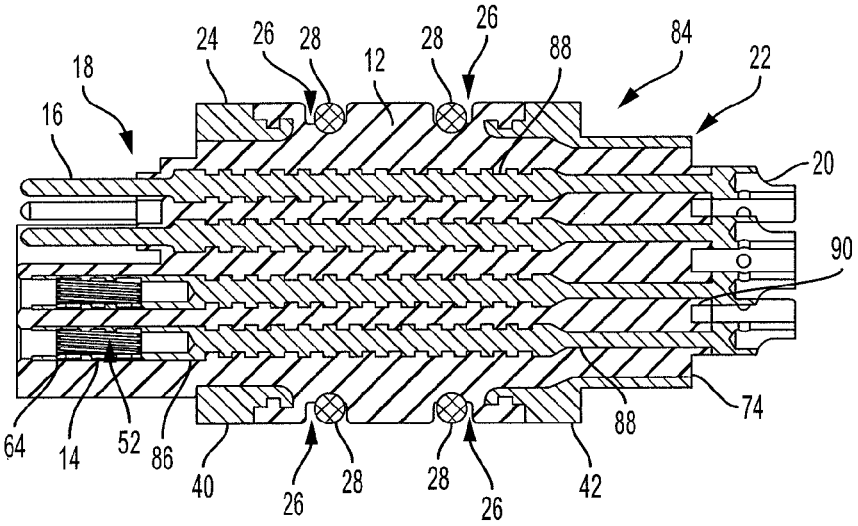
FIG. 7 illustrates a side cross sectional view of an electrical connector, according to an embodiment of the present disclosure.

FIG. 7 illustrates a side cross sectional view of an electrical connector 84 for use in oil and gas applications, for instance, for use with downhole tools. The electrical connector 84 operates similarly as the electrical connector 10, however, the rear tail 86 is integral with the conductor pin 88. The integral nature of the connection between the rear tail 86 and the conductor pin 88 may improve the structural resiliency of the connection between these components. A posterior portion of the conductor pin 88 may be integral with an anterior portion of an electrical contact 20. The electrical contacts 16 may similarly be integrally connected to a respective conductor pin 88.

In the embodiment of FIG. 7, the body 12 may be overmolded along the length of the conductor pin 88. The conductor pin 88 may include grooves that improve the connection between the body 12 and the conductor pin 88. The overmolding of the body 12 to the conductor pin 88 may form a sealed connection that seals a pressure differential across a structure that the electrical connector 84 is inserted into, for example, a bulkhead.

In the embodiment of FIG. 7, the body 12 may include a plurality of grooves 26, each containing a respective sealing device such as an o-ring 28, or other form of sealing device.

In one embodiment, the connectors 10, 84 may be modified to only include a single electrical contact at the anterior end 18 of the connector, and a single electrical contact at the posterior end 22 of the connector. A single conductor pin may be utilized to connect the electrical contacts. In one embodiment, a number of electrical contacts may be greater or lesser than shown in FIGS. 1 and 7.

In one embodiment, the type of electrical contact may be varied than shown in FIGS. 1 and 7. For example, any of the electrical contacts may be varied to include male or female contacts, or pin, solder cup, or socket contacts, or the like. In one embodiment, an end of the connector may be modified to include all male or all female electrical contacts, or a hermaphroditic configuration as shown on the anterior end 18 of the connectors 10, 84 may be used.

Figure 8:
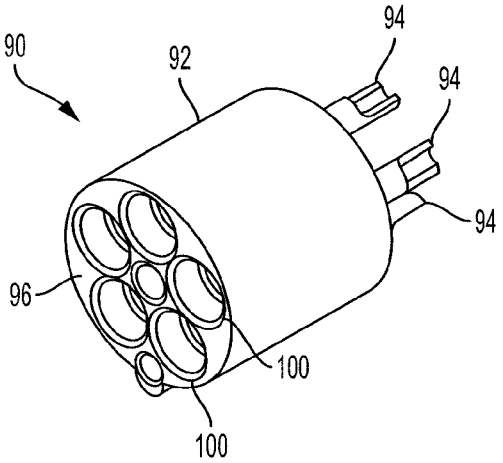
FIG. 8 illustrates a side perspective view of an electrical contact block for use in oil and gas applications, according to an embodiment of the present disclosure.

FIG. 8 illustrates a side perspective view of an electrical connector in the form of an electrical contact block 90 for use in oil and gas applications, for instance, for use with downhole tools. The electrical contact block 90 may include a body 92 and a plurality of electrical contacts 94 (shown in FIG. 10) that are positioned in the body 92.

The body 92 may be an insulative body, and may be made of a plastic material such as a thermoplastic or the like. The body 92 may have a cylindrical shape as shown in FIG. 8.

The body 92 may be sized to fit within a port of a bulkhead, which may be the bulkhead 78 described in regard to FIG. 5.

The body 92 may include an anterior face 96 having a plurality of openings 100, each for receiving a male electrical contact. The body 92 may include a posterior face 98 having a plurality of openings 102 (marked in FIG. 10). The body 92 may include an exterior surface 104 that extends from the anterior face 96 at the anterior end of the body 92 to the posterior face 98 at the posterior end of the body 92.

Figure 9:
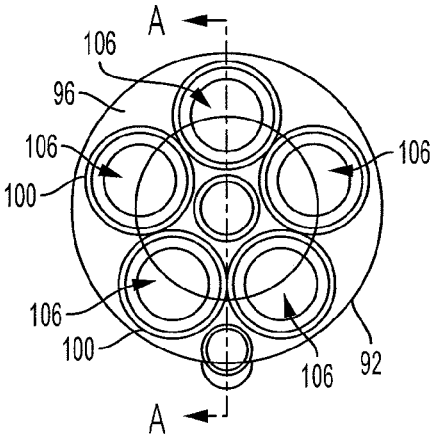
FIG. 9 illustrates a front view of an anterior face of an electrical contact block, according to an embodiment of the present disclosure.

FIG. 9 shows a front view of the anterior face 96 of the body 92. The body 92 may include a plurality of cavities 106.

Figure 10:
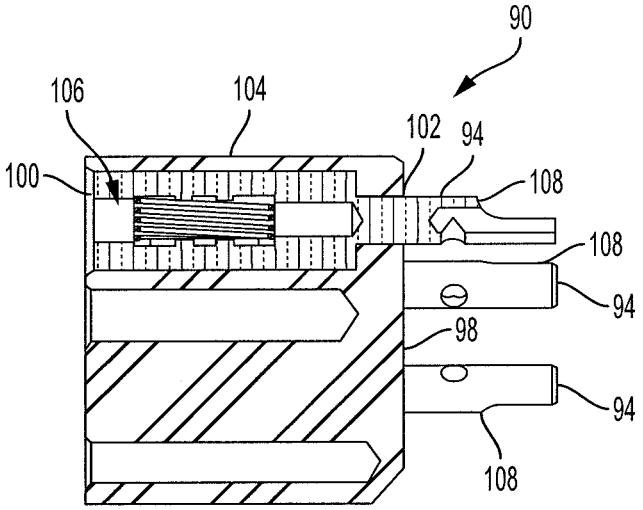
FIG. 10 illustrates a cross sectional view of an electrical contact block along line A-A in FIG. 9, according to an embodiment of the present disclosure.

FIG. 10 shows a cross sectional view of the electrical contact block 90 along line A-A in FIG. 9. Each of the electrical contacts 94 are positioned in a respective cavity 106 of the body 92. Each of the electrical contacts 94 may be configured similarly as the electrical contact 14 of the electrical connector 10 for example. For instance, the electrical contacts 94 may comprise female contacts that may receive male electrical contacts through respective openings 100 in the anterior face 96 of the body 92. The electrical contacts 94 may be configured to include at least one elongate contact element defining a cavity for receiving a male electrical contact. The at least one elongate contact element may be configured to flex away from the cavity to accommodate the male electrical contact. In one embodiment, the at least one elongate contact element may be a plurality of elongate contact elements. The elongate contact elements may be positioned in a hyperboloid configuration for receiving a male electrical contact, as shown and described in regard to FIGS. 2-4 for example.

The rear tail 108 of each of the electrical contacts 94 may extend through a respective opening 102 on the posterior face 98 of the body 92. The rear tail 108 may include a cavity for connection to an electrical contact.

In operation, the electrical contact block 90 may be configured to connect to a posterior end of an electrical connector that seals differential pressure across a bulkhead, such as the electrical connectors 10, 84 shown in FIGS. 1 and 7. The anterior end of the electrical contact block 90 may receive the posterior electrical contacts of the electrical connectors 10, 84. When installed in a bulkhead 78, the electrical contact block 90 may be positioned in a tertiary chamber 110 of the bulkhead 78 to receive the electrical contacts. The electrical contact block 90 accordingly may not be configured to seal a differential pressure across the bulkhead, as the electrical connectors 10, 84 may have already served this purpose. However, the electrical contact block 90 may be exposed to a hydrostatic pressure on the low pressure side of the bulkhead.

The use of the electrical contacts 94 including at least one elongate contact element defining a cavity for receiving a male electrical contact provides similar benefits as their use in the electrical contacts 14. Namely, unexpected resistance to thermal stress relaxation and shock and vibration is provided.

In one embodiment, the electrical contact block 90 may be configured to vary the number of electrical contacts 94 used. For example, in one embodiment, only one electrical contact 94 may be utilized. In one embodiment, one or more electrical contacts 94 may be utilized. In one embodiment, five or more electrical contacts 94 may be utilized.

In one embodiment, the structure of the rear tail 108 may be varied. For example, in the embodiment shown in FIGS. 8-10, the rear tail 108 includes solder cups for connection. In one embodiment, a male or female connector, or pin, solder cup, or socket contacts, or the like may be utilized.

In one embodiment, the angle of the electrical contacts 94 may be varied. For example, in the embodiment shown in FIGS. 8-10, the electrical contacts 94 extend parallel to each other. In one embodiment, the angle may be varied to account for the type of electrical contact that the electrical contacts 94 are configured to receive.

Figure 11:
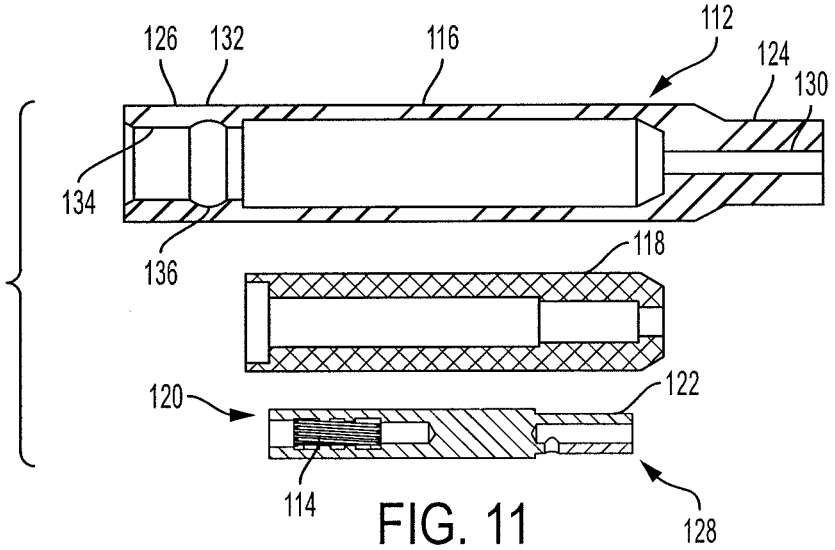
FIG. 11 illustrates a side cross sectional view of an electrical contact kit, according to an embodiment of the present disclosure.

FIG. 11 illustrates a side cross sectional view of an electrical connector in the form of an electrical contact kit 112 for forming a sealed connection with a mating connector. The kit 112 may include an electrical contact 114, a rubber shroud 116, and an insulating body 118.

The electrical contact 114 may be configured similarly as the electrical contact 14 of the electrical connector 10 for example. For instance, the electrical contact 114 may comprise a female contact that may receive a male electrical contact through an anterior end 120 of the electrical contact 114. The electrical contact 114 may be configured to include at least one elongate contact element defining a cavity for receiving a male electrical contact. The at least one elongate contact element may be configured to flex away from the cavity to accommodate the male electrical contact. In one embodiment, the at least one elongate contact element may be a plurality of elongate contact elements. The elongate contact elements may be positioned in a hyperboloid configuration for receiving the male electrical contact, as shown and described in regard to FIGS. 2-4 for example.

The rear tail 122 of the electrical contact 114 may include a cavity for connection to an electrical contact, such as an electrically connective portion of a wire or the like.

The rubber shroud 116 includes a posterior portion 124 and an anterior portion 126. The rubber shroud 116 is configured to extend over the electrical contact 114 from the anterior end 120 of the electrical contact to the posterior end 128 of the electrical contact 114. The rubber shroud 116 surrounds the electrical contact 114. The posterior portion 124 of the electrical contact 114 is configured to extend axially posterior from the posterior end 128 of the electrical contact 114. The posterior portion 124 includes a cavity 130 for a wire or the like to pass through when the rubber shroud 116 extends over the electrical contact 114. The posterior portion 124 forms a sealed connection to the wire via a stretch fit or the like.

Figure 14:
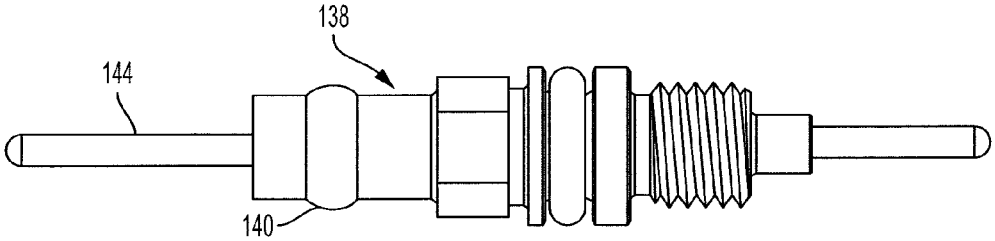
FIG. 14 illustrates a side view of a mating connector, according to an embodiment of the present disclosure.

The anterior portion 126 of the rubber shroud 116 is configured to protrude axially anterior from the first end 120 of the electrical contact 114 when the rubber shroud 116 extends over the electrical contact 114, to form a lip. The anterior portion 126 may be configured to extend over a portion of a mating connector to form a sealed connection with the mating connector. The anterior portion 126 may include an exterior surface 132 and an interior surface 134. The interior surface 134 may include a recess 136 that is shaped to extend over a protruding portion of a mating connector. FIG. 14, for example, displays a mating connector 138 having a protruding portion 140. The recess 136 may extend over the protruding portion 140 to enhance the seal between the mating connector and the rubber shroud 116 via a stretch fit or the like.

The insulating body 118 is configured to extend over the electrical contact 114 and be positioned between the electrical contact 114 and the rubber shroud 116 when the kit 112 is assembled. The insulating body 118 surrounds the electrical contact 114. The insulating body 118 may be made of a plastic material such as a thermoplastic or the like. In one embodiment, the insulating body 118 may be excluded from the kit 112.

Figure 12:
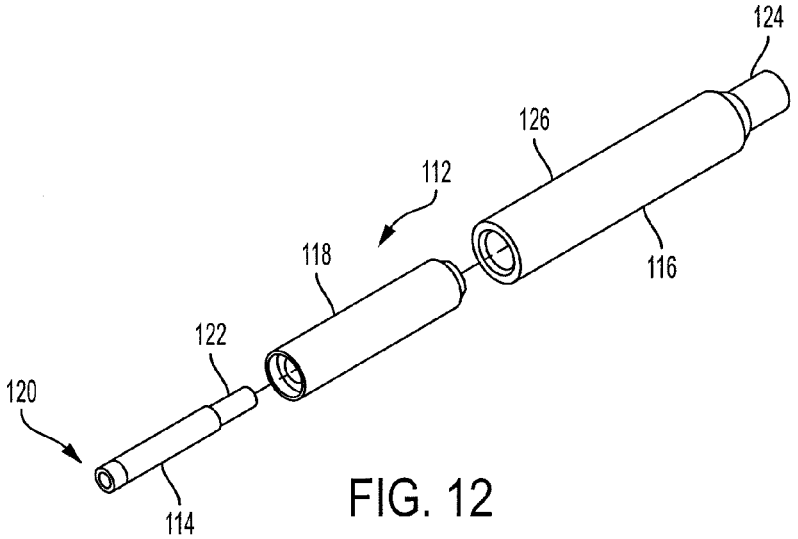
FIG. 12 illustrates a perspective view of the electrical contact kit shown in FIG. 11.

FIG. 12 illustrates a perspective view of components of the kit 112 prior to assembly.

Figure 13:
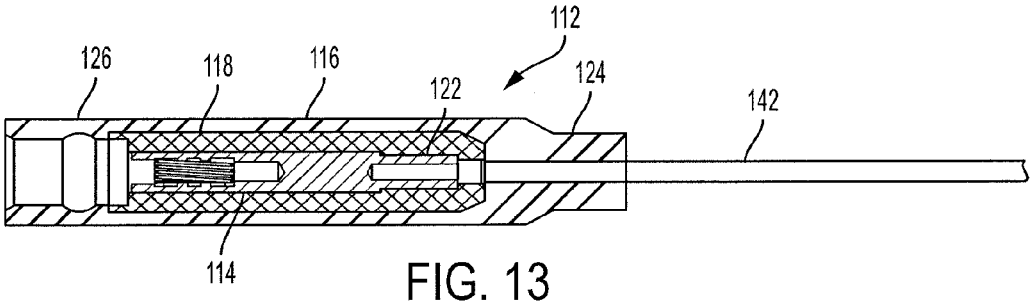
FIG. 13 illustrates a side cross sectional view of an assembled electrical contact kit, according to an embodiment of the present disclosure.

FIG. 13 illustrates the kit 112 assembled, with the insulating body 118 extending over the electrical contact 114 and the rubber shroud 116 extending over the insulating body 118. A wire 142 extends through the posterior portion 124 of the rubber shroud 116 to connect to the rear tail 122 of the electrical contact 114. The wire may connect to the rear tail 122 via a crimping or solder connection, or the like. In operation, the assembled kit 112 receives a mating connector 138 as shown in FIG. 14 for example. The rubber shroud 116 forms a sealed connection with the mating connector 138, to prevent gas and liquid pressure from passing through the connection interface to the mating connector 138. The rubber shroud serves as a boot for the electrical contact 114. The assembled kit 112 may be used in combination with an electrical connector that seals a differential pressure across a bulkhead, such as the electrical connectors 10, 84 shown in FIGS. 1 and 7. When the electrical connectors 10, 84 are installed in a bulkhead 78, the assembled kit 112 may be positioned on the high pressure side of the electrical connectors 10, 84. The assembled kit 112 may be configured to receive a single male electrical contact, for example the male electrical contact 144 shown in FIG. 14. In one embodiment, the assembled kit 112 may be configured to receive multiple male or female electrical contacts.

Figure 15:
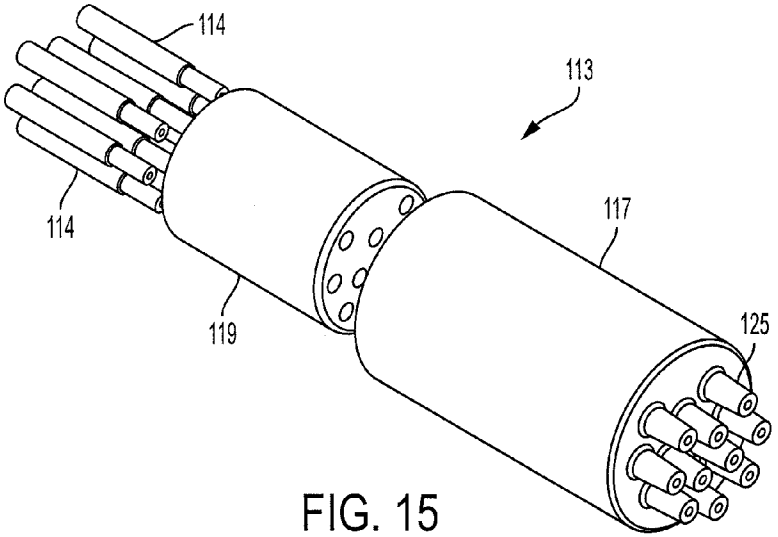
FIG. 15 illustrates a rear perspective view of an electrical contact kit, according to an embodiment of the present disclosure.

FIG. 15 illustrates a rear perspective view of an electrical contact kit 113 configured to receive multiple male electrical contacts. The electrical contact kit 113 may include a rubber shroud 117 that is similar to the rubber shroud 116, yet configured to accommodate multiple electrical contacts 114. The electrical contact kit 113 may include an insulating body 119 that is similar to the insulating body 118, yet configured to accommodate multiple electrical contacts 114.

Figure 16:
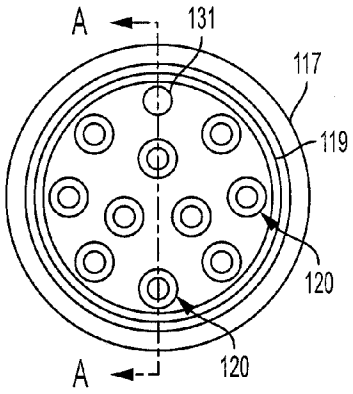
FIG. 16 illustrates a front view of the electrical contact kit shown in FIG. 15.

FIG. 16 illustrates a front view of the electrical contact kit 113. The insulating body 119 may include an alignment cavity 131 configured to receive an alignment pin 115 of a mating connector 139, as shown in FIG. 18 for example.

Figure 17:
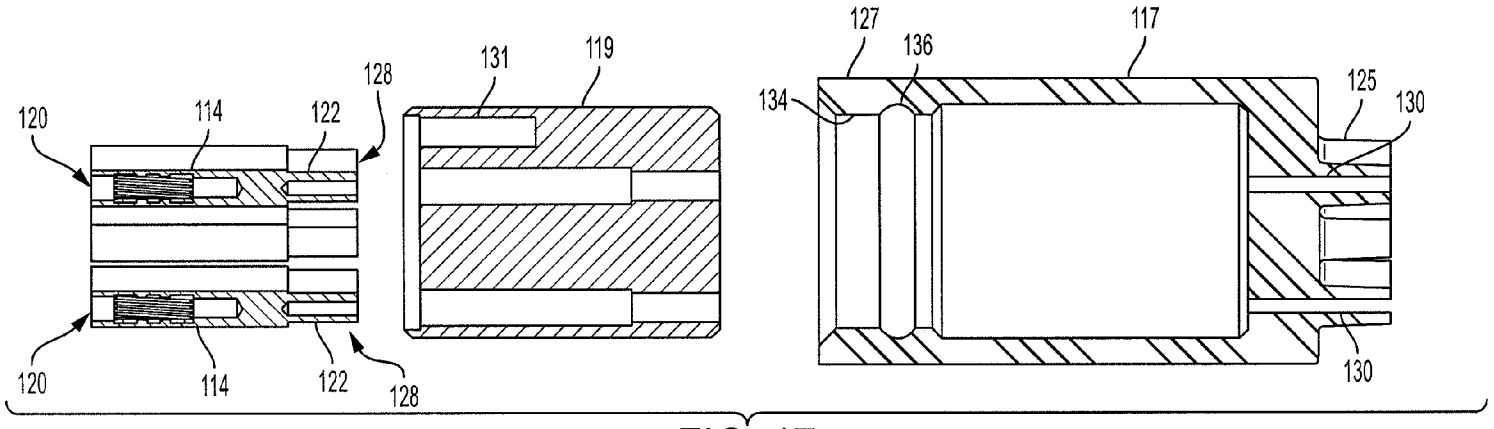
FIG. 17 illustrates a side cross sectional view of the electrical contact kit shown in FIG. 15 taken along line A-A in FIG. 16.

FIG. 17 shows a side cross sectional view of the electrical contact kit 113 along line A-A in FIG. 16. The rubber shroud 117 may include a plurality of cavities 130 at the posterior portion 125 of the shroud 117, each cavity 130 configured for a wire or the like to pass through to electrically connect to a respective electrical contact 114. The anterior portion 127 of the rubber shroud 117 may include a recess 136 that is shaped to extend over a protruding portion of a mating connector 139, as shown in FIG. 18 for example.

The insulating body 119 may include a plurality of cavities each for receiving a respective electrical contact 114. The anterior face of the insulating body 119 may include an opening for the alignment cavity 131.

Figure 19:
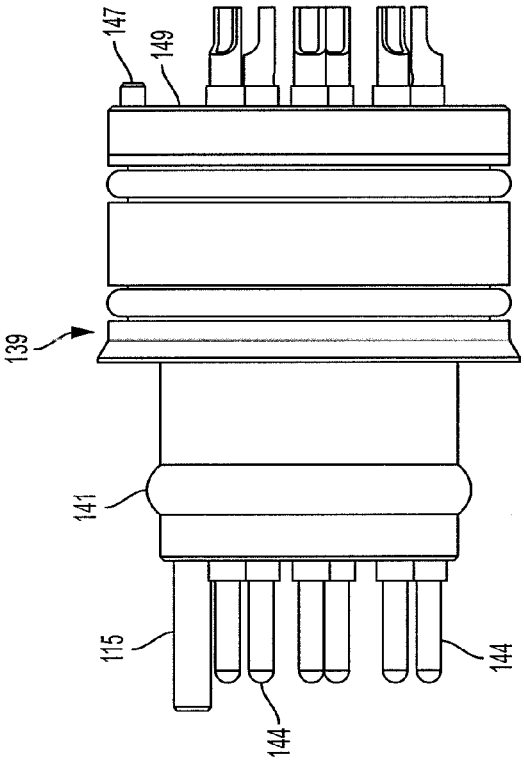
FIG. 19 illustrates a side view of the mating connector shown in FIG. 18.
Figure 18:
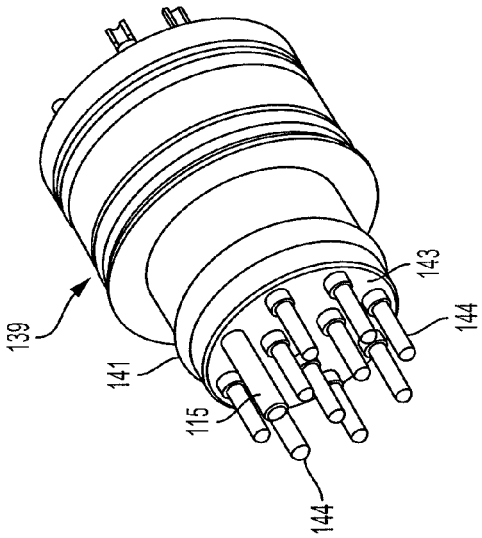
FIG. 18 illustrates a front perspective view of a mating connector, according to an embodiment of the present disclosure.

FIG. 18 shows a front perspective view of a mating connector 139 that includes a protruding portion 141. FIG. 19 shows a side view of the mating connector 139. The protruding portion 141 may be configured similarly as the protruding portion 140 shown in FIG. 14, as the recess 136 of the rubber shroud 117 may extend over the protruding portion 141 to enhance the seal between the mating connector 139 and the rubber shroud 117 via a stretch fit or the like.

The mating connector 139 includes a plurality of male electrical contacts 144 for connection with the electrical contacts 114 of the boot kit 113. The mating connector 139 may include an alignment pin 115 protruding from the anterior face 143 of the connector 139. The alignment pin 115 may be received by the alignment cavity 131 of the insulating body 119 to align the connection between the mating connector 139 and the electrical contact kit 113.

The mating connector 139 may include a rear alignment pin 147 extending posteriorly from the posterior surface 149 of the mating connector 139.

Figure 20:
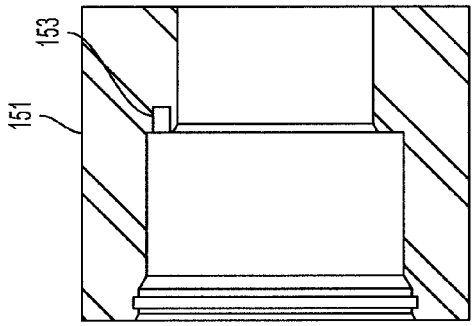
FIG. 20 illustrates a cross sectional view of a bulkhead, according to an embodiment of the present disclosure.

The mating connector 139 may be configured to seal a pressure differential across a structure that the mating connector 139 is inserted into, for example, a bulkhead 151 as shown in FIG. 20. The mating connector 139 may be constructed similarly as the connectors 10 and 84, as the connector 139 may be configured to seal a pressure differential. The rear alignment pin 147 may align with an alignment cavity 153 in the bulkhead 151. The mating connector 138 shown in FIG. 14 may similarly be constructed to seal a pressure differential across a structure such as a bulkhead. In one embodiment, the connectors 10 and 84 may be modified to include any of the features disclosed in regard to the mating connectors 138, 139, for example, a protruding portion for mating with a rubber shroud of an electrical contact kit 112, 113.

In one embodiment, the assembled kits 112, 113 may be modified to connect to a hermaphroditic series of electrical contacts. The kits 112, 113 may include both male and female electrical contacts to electrically connect with the hermaphroditic series of contacts. Corresponding numbers of wires 142 or other conduits may be used to transfer power or signal from the multiple electrical contacts.

The use in the electrical contact kits 112, 113 of the electrical contact 114 including at least one elongate contact element defining a cavity for receiving a male electrical contact provides similar benefits as their use in the electrical contacts 14. Namely, unexpected resistance to thermal stress relaxation and shock and vibration is provided.

Figure 22:
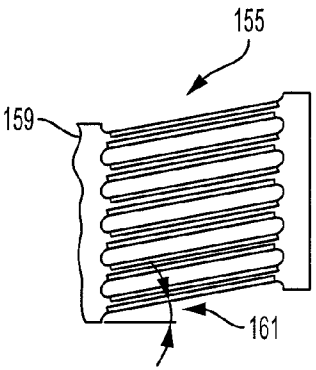
FIG. 22 illustrates a plan view of a sheet of material, according to an embodiment of the present disclosure.
Figure 21:
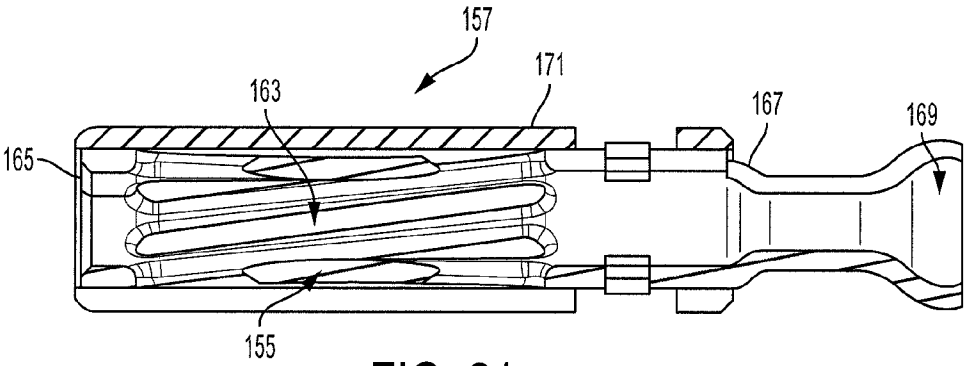
FIG. 21 illustrates a cross sectional side view of an electrical contact, according to an embodiment of the present disclosure.

The elongate contact elements disclosed in this application are not limited to the wire structure shown in FIGS. 2 and 3 and may include beams 155 as shown in FIG. 21. Other structures for the elongate contact elements may include struts, slats, or other structures. FIG. 21 illustrates a cross sectional side view of an electrical contact 157 including beams 155 defining a cavity for receiving a male electrical contact. The beams may be configured to flex away from the cavity to accommodate the male electrical contact. The beams 155 are positioned in a hyperboloid configuration for receiving a male electrical contact, in a similar manner as disclosed regarding the wire structure in FIGS. 2 and 3. The beams 155 may be formed by being punched from a sheet 159 of material, as shown in FIG. 22. The beams 155 may be punched at an angle 161. The sheet 159 is then rolled to define the cavity 163 for receiving the male contact, similar to the cavity 60 shown in FIG. 3. The angle of the beams 155 forms the hyperboloid configuration of the electrical contact 157.

The anterior ends the beams 155 are connected by a forward ring 165. The posterior ends of the beams 155 are connected by a rear tail 167. The rear tail 167 may include a cavity 169 for connecting to another contact, such as a conductive pin or the like.

A tube 171 may extend over the beams 155 to secure the beams 155 in position.

Figure 24:
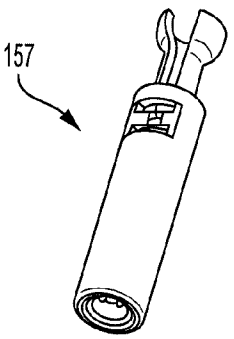
FIG. 24 illustrates a front perspective view of the connector shown in FIG. 21.
Figure 23:
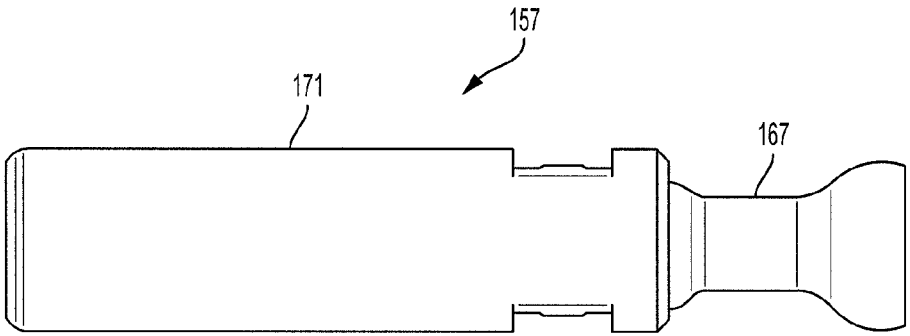
FIG. 23 illustrates a side view of the electrical connector shown in FIG. 21.

FIG. 23 illustrates a side view of the electrical contact 157. FIG. 24 illustrates a side perspective view of the electrical contact 157.

The at least one elongate contact element defining a cavity disclosed in this application is not limited to a hyperboloid configuration. In one embodiment, the at least one elongate contact element may form a helical shape as shown in FIG.

25. In other embodiments, the at least one elongate contact element may form other shapes.

Figure 25:
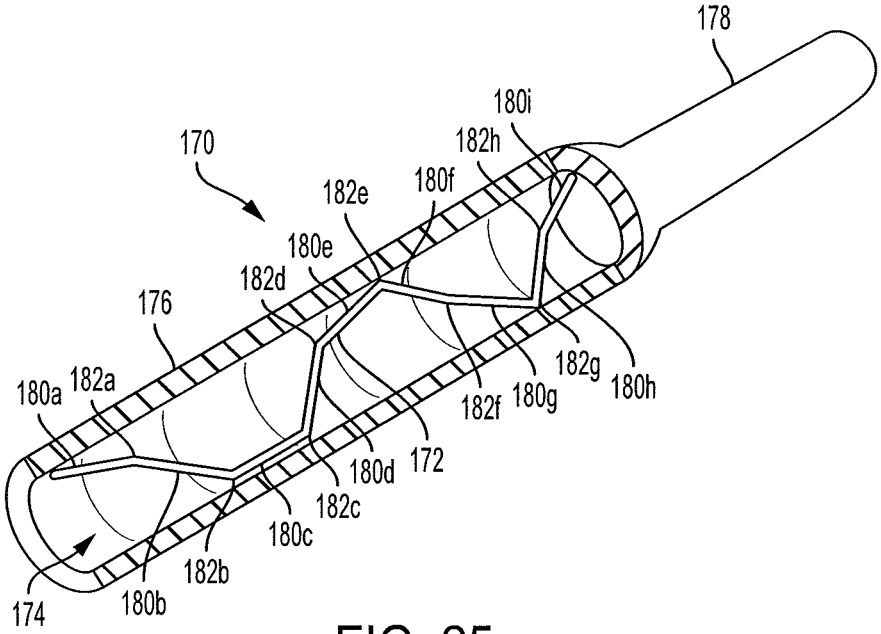
FIG. 25 illustrates a cross sectional perspective view of an electrical contact, according to an embodiment of the present disclosure.

FIG. 25 illustrates a cross sectional side perspective view of an electrical contact 170 including at least one elongate contact element in the form of a wire 172 extending in a helical shape around a cavity 174. The wire 172 may form a single helical shape extending around the cavity 174. The wire 172 may be configured to flex away from the cavity 174 upon a male electrical contact being inserted therein. The wire 172 may be resilient such that the wire 172 moves towards its original position upon the male contact being withdrawn from the cavity 174.

The electrical contact 170 may include a tube 176 extending around the wire 172. The tube 176 may maintain the helical shape of the wire 172. The wire 172 may exert a force against the interior surface of the tube 176. The electrical contact 170 may include a rear tail 178. The rear tail 178 may include a pin that inserts into a portion of a connector body to complete an electrical connection from the wire 172.

Figure 26:
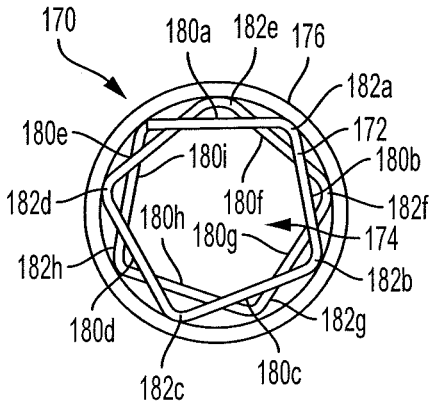
FIG. 26 illustrates a front view of the electrical contact shown in FIG. 25.

FIG. 26 illustrates a front view of the electrical contact 170. The wire 172 may form a pentagonal helical shape, in which the wire 172 forms five sides upon a complete revolution within the tube 176. The helical shape of the wire 172 may form contact portions 180*a*-180*i* for contacting a male electrical contact. The contact portions 180*a*-180*i* may form flat portions of the helical shape of the wire 172. The helical shape of the wire 172 may form contact portions 182*a*-182*h* for contacting the tube 176. The contact portions 182*a*-182*h* may form angled portions of the helical shape of the wire 172.

The configuration of the beams 155 or the helical shape of the wire 172, or the configuration of the electrical contacts 157, 170 may be utilized in any of the electrical contacts disclosed in this application.

Figure 27:
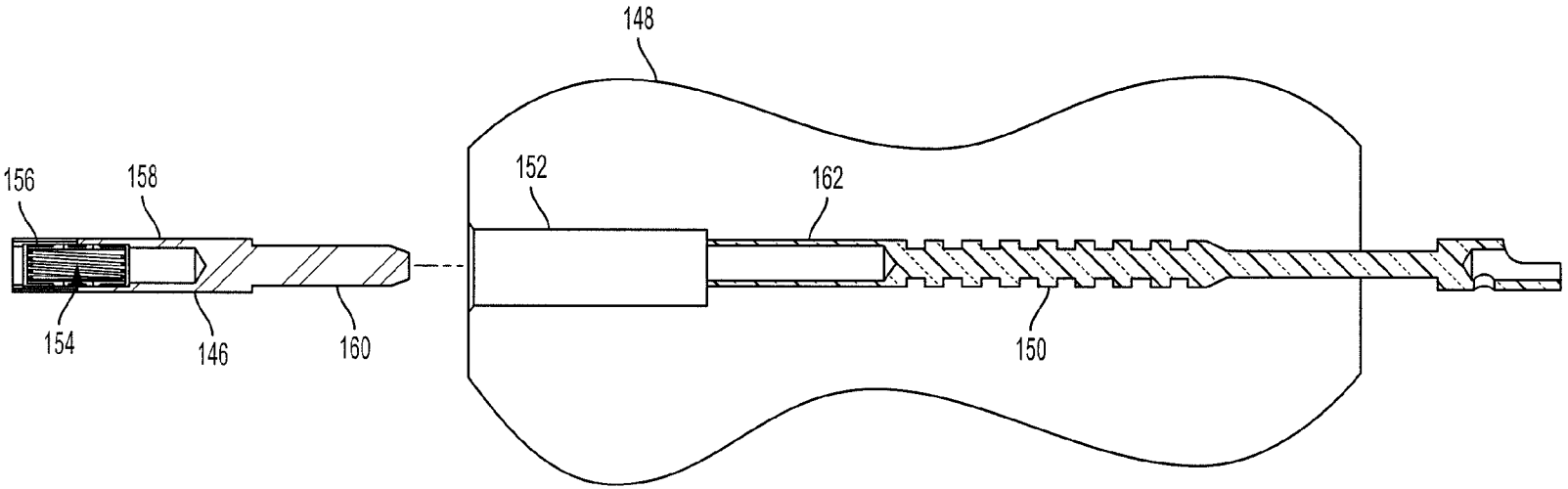
FIG. 27 illustrates a side cross sectional view of a method of manufacturing a combination of an electrical contact with a body, according to an embodiment of the present disclosure.

FIG. 27 illustrates an embodiment of a method of manufacturing a combination of an electrical contact 146 including at least one elongate contact element defining a cavity for receiving a male electrical contact, with a body 148, for use in a connector for oil and gas applications. The at least one elongate contact element may comprise wires 154 positioned in a hyperboloid configuration for receiving a male electrical contact. The method may be utilized to form any of the electrical connectors discussed herein, including contact blocks or electrical contact kits discussed herein. The method may include overmolding a connector body 148 upon a conductor pin 150. During the overmolding process, a cavity 152 may be formed that is configured to receive the electrical contact 146. The cavity 152 may be machined after an overmolding process in which the body 148 is formed. The cavity 152 is coupled to the connector body 148. The electrical contact 146, including the plurality of wires 154, the forward ring 156, and the rear tail 158 may be press fit into the cavity 152, or otherwise attached to the body 148. The rear tail 158 may include a pin 160 that inserts into a cavity 162 of the conductor pin 150 to complete the electrical connection between the electrical contact 146 and the conductor pin 150. The cavity 162 may be machined after an overmolding process in which the body 148 is formed. The cavity 162 is coupled to the connector body 148.

Figure 28:
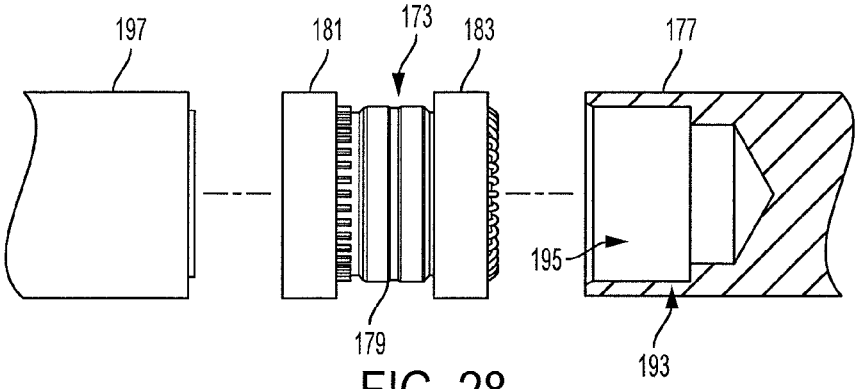
FIG. 28 illustrates a side view of a method of manufacturing a combination of an electrical contact with a body, according to an embodiment of the present disclosure.

FIG. 28 illustrates an embodiment of a method of manufacturing a combination of an electrical contact 173 including at least one elongate contact element defining a cavity for receiving a male electrical contact, with a body 177, for use in a connector for oil and gas applications. The at least one elongate contact element may comprise wires 175 positioned in a hyperboloid configuration for receiving a male electrical contact. The method may be utilized to form any of the electrical connectors discussed herein, including contact blocks or electrical contact kits discussed herein. The electrical contact 173 may include a central tube 179, a forward ring 181, and a slide ring 183.

Figure 29:
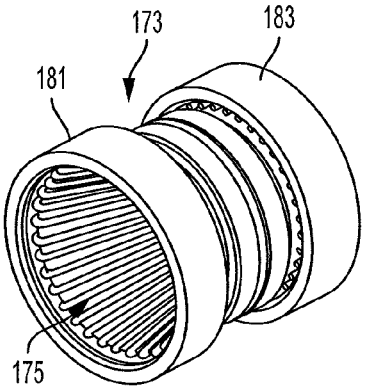
FIG. 29 illustrates a front perspective view of the electrical contact shown in FIG. 28.
Figure 30:
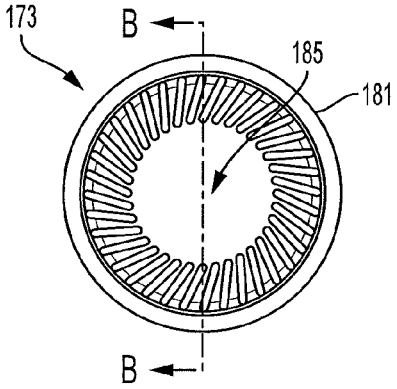
FIG. 30 illustrates a front view of the electrical contact shown in FIG. 28.

FIG. 29 illustrates a front perspective view of the electrical contact 173. FIG. 30 illustrates a front view of the electrical contact 173.

Figure 31:
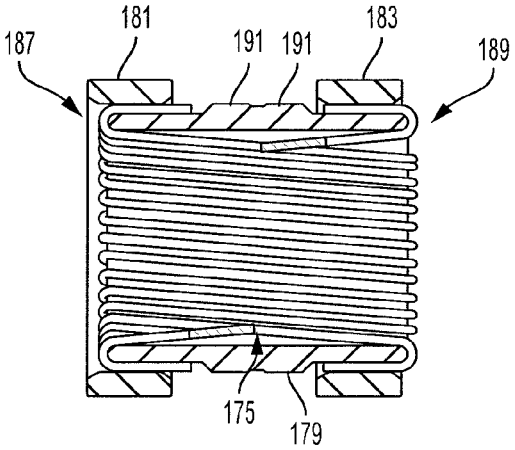
FIG. 31 illustrates a cross sectional view of the electrical contact shown in FIG. 28, taken along line B-B in FIG. 30.

FIG. 31 illustrates a cross sectional view of the electrical contact 173 taken along line B-B in FIG. 30. The wires 175 have a hyperboloid configuration in that a cavity 185 (marked in FIG. 30) formed by the wires 175 for receiving a male contact reduces in diameter at a middle of the axial length of the wires 175.

The central tube 179 may include an interior cavity for containing the plurality of wires 175. The respective ends 187, 189 of the wires 175 may be bent over the ends of the central tube 179 to connect the wires 175 to the central tube 179. The forward ring 181 may include a cavity for the male contact to pass through to enter the cavity 185. The forward ring 181 may extend over the central tube 179 and the wires 175 at the anterior end 187 of the wires to secure the wires 175 in the hyperboloid configuration.

The exterior surface of the central tube 179 may include one or more raised portions 191. The raised portions 191 may be positioned centrally along the central tube 179, and may extend circumferentially around the exterior surface of the central tube 179. The raised portions 191 may have a height that is substantially equal to or greater than the diameter of the wires 175.

The slide ring 183 may extend over the central tube 179 and the wires 175 at the posterior end 189 of the wires to secure the wires 175 in the hyperboloid configuration. The slide ring 183 may be configured to slide relative to the central tube 179.

Figure 32:
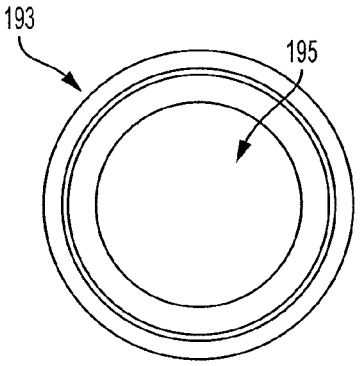
FIG. 32 illustrates a front view of the cavity shown in FIG. 28.

The body 177 may be configured to electrically connect to the electrical contact 173. The body 177 may be formed through a molding process, in which an electrically conductive shank 193 is overmolded with body material. The molding process may leave the cavity 195 of the shank 193 open for receiving the electrical contact 173. In one embodiment, the cavity 195 may be machined after an overmolding process in which the body 177 is formed. The cavity 195 is coupled to the body 177. FIG. 32 illustrates a front view of the cavity 195.

Referring to FIG. 28, the electrical contact 173 may be pressed into the cavity 195 using a punch 197 or the like. The electrical contact 173 may be pressed into the cavity 195 as an assembled unit, with the posterior end of the electrical contact 173 inserted first into the cavity 195. The sizing of the cavity 195 relative to the electrical contact 173 may be configured such that the diameter of the electrical contact 173 is greater than the diameter of the cavity 195.

Figure 33:
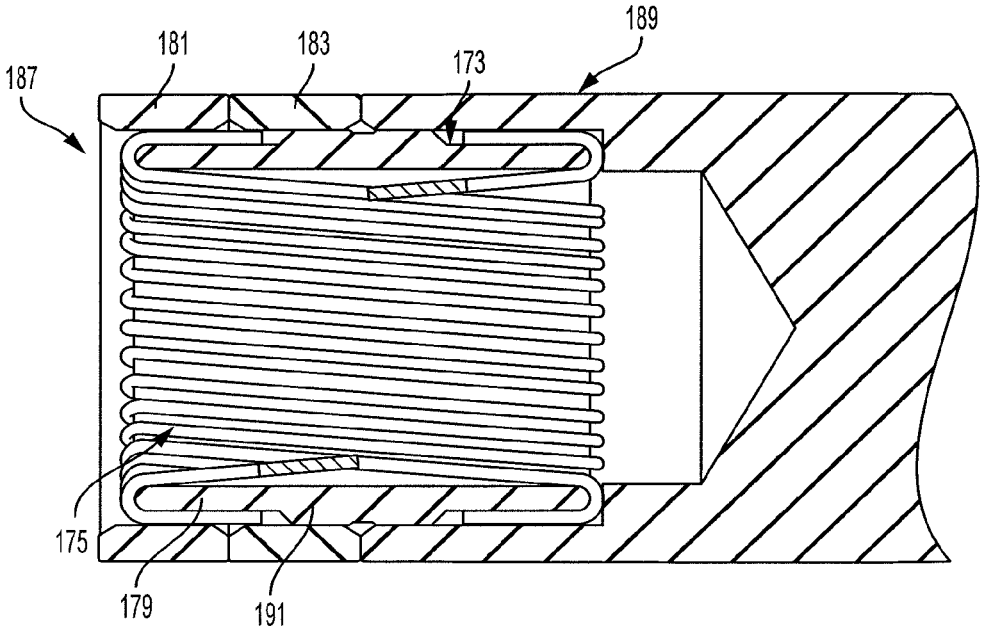
FIG. 33 illustrates a side cross sectional view of the electrical connector shown in FIG. 28 inserted into the body shown in FIG. 28.

FIG. 33 illustrates a side cross sectional view of the electrical contact 173 after the contact 173 has been inserted into the cavity 195. The slide ring 183, having a larger diameter than the diameter of the cavity 195 is slid anteriorly towards the forward ring 181. The slide ring 183 may slide anteriorly until the slide ring 183 contacts the forward ring 181. The anterior surface of the slide ring 183 may contact an anterior raised portion 191, and may contact the anterior ends 187 of the wires 175. A posterior raised portion 191 may have a form fit with the interior surface of the cavity 195. The posterior ends 189 of the wires 175 may contact the interior surface of the cavity 195.

Benefits of the method of assembly shown in FIGS. 27, 28, and 33 include a reduced possibility of damage to the plurality of wires during the overmolding process, via mechanical stress, pressure collapse, plastic ingress during the molding process, or other undesired entry of the bodies 148, 177 into the respective electrical contacts 146, 173, for example, between the wires. Possible tolerance issues with the electrical contacts 146, 173 are also reduced. Specific to the embodiment shown in FIGS. 28 and 33, one benefit is the reduced number of electrical interfaces between the electrical components, which may make the electrical contact 173 more reliable and have lower contact resistance.

Other methods of installing the electrical contact 146, 173 may include a slip-fit, or spring retention, for example.

The combination of the electrical connectors, contact blocks, or electrical contact kits discussed herein, may form a system for use in oil and gas applications, for instance, for use with downhole tools. For example, the electrical connectors, contact blocks, or electrical contact kits may be connected to each other to carry an electrical signal or power through a bulkhead, such as a bulkhead 78 shown in FIG. 5. The use of at least one elongate contact element defining a cavity for receiving a male electrical contact in any component of such a system would provide similar benefits as their use in the electrical contacts 14. Namely, such a configuration provides unexpected resistance to thermal stress relaxation and shock and vibration. The use in such a system of multiple electrical contacts that include the at least one elongate contact element defining a cavity for receiving a male electrical contact, would serve to improve the unexpected resistance to thermal stress relaxation and shock and vibration across the system.

Figure 34:
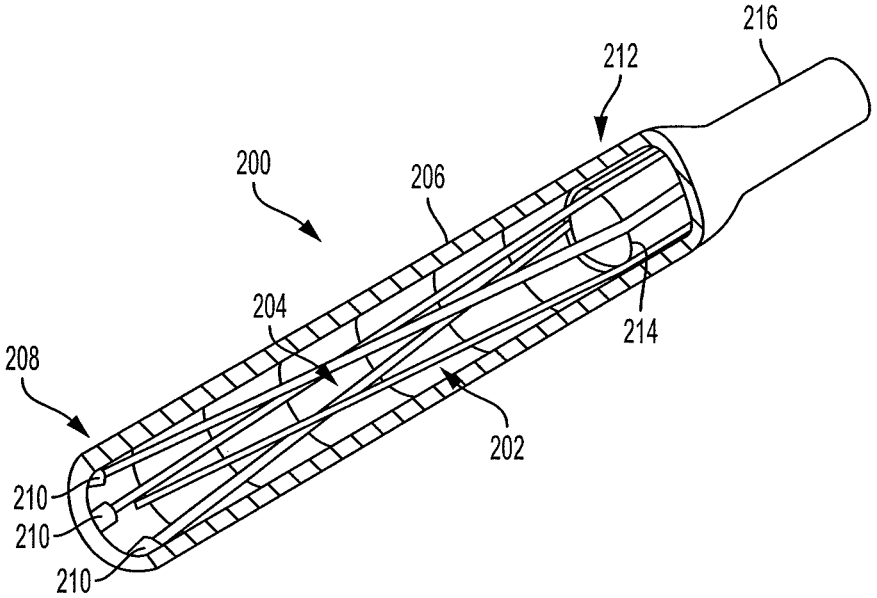
FIG. 34 illustrates a cross sectional perspective view of an electrical contact, according to an embodiment of the present disclosure.

FIG. 34 illustrates a cross sectional side perspective view of an electrical contact 200 including at least one elongate contact element 202 defining a cavity 204 for receiving a male electrical contact. The at least one elongate contact element 202 may be configured as a plurality of elongate contact elements 202, and may be positioned in a hyperboloid configuration for receiving a male electrical contact. The elongate contact elements 202 may be configured to flex away from the cavity 204 to accommodate the male electrical contact. The elongate contact elements 202 may be in the form of wires.

A tube 206 may extend over the elongate contact elements 202. Anterior ends 208 of the elongate contact elements 202 may connect directly to, and may extend into the tube 206. In one embodiment, the anterior ends of the elongate contact elements 202 may extend into retainers 210 in the tube 206. The retainers 210 may have the form of cavities in the tube for receiving the ends of the elongate contact elements 202.

The posterior ends of the elongate contact elements 202 may connect to the posterior end of the tube 206. The posterior ends 212 of the elongate contact elements 202 may be sandwiched between an inner block 214 and an inner surface of the tube 206. In one embodiment, the posterior ends 212 of the elongate contact elements 202 may connect directly to, and may extend into the tube 206. The electrical contact 200 may include a rear tail 216. The rear tail 216 may include a pin that inserts into a portion of a connector body to complete an electrical connection from the plurality of elongate contact elements 202. In one embodiment, the rear tail 216 may include a cavity for connecting to another contact, such as a conductive pin or the like.

Figure 35:
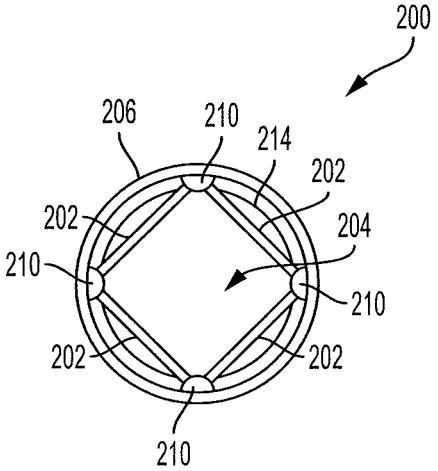
FIG. 35 illustrates a front view of the electrical contact shown in FIG. 34.

FIG. 35 illustrates a front view of the electrical contact 200. The inner block 214 may be spaced from the inner surface of the tube 206 to sandwich the posterior ends of the electrical contact elements 202 therebetween.

The configuration of the elongate contact elements 202 or the configuration of the electrical contact 200 may be utilized in any of the electrical contacts disclosed in this application.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of systems, apparatuses, and methods as disclosed herein, which is defined solely by the claims. Accordingly, the systems, apparatuses, and methods are not limited to that precisely as shown and described.

Certain embodiments of systems, apparatuses, and methods are described herein, including the best mode known to the inventors for carrying out the same. Of course, variations on these described embodiments will become apparent to those of ordinary skill in the art upon reading the foregoing description. The inventor expects skilled artisans to employ such variations as appropriate, and the inventors intend for the systems, apparatuses, and methods to be practiced otherwise than specifically described herein. Accordingly, the systems, apparatuses, and methods include all modifications and equivalents of the subject matter recited in the claims appended hereto as permitted by applicable law. Moreover, any combination of the above-described embodiments in all possible variations thereof is encompassed by the systems, apparatuses, and methods unless otherwise indicated herein or otherwise clearly contradicted by context.

Groupings of alternative embodiments, elements, or steps of the systems, apparatuses, and methods are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses an approximation that may vary. The terms "approximate[ly]" and "substantial[ly]" represent an amount that may vary from the stated amount, yet is capable of performing the desired operation or process discussed herein.

The terms "a," "an," "the" and similar referents used in the context of describing the systems, apparatuses, and methods (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the systems, apparatuses, and methods and does not pose a limitation on the scope of the systems, apparatuses, and methods otherwise claimed. No language in the present specification should be construed as indicating any non-claimed element essential to the practice of the systems, apparatuses, and methods.

All patents, patent publications, and other publications referenced and identified in the present specification are individually and expressly incorporated herein by reference in their entirety for the purpose of describing and disclosing, for example, the compositions and methodologies described in such publications that might be used in connection with the systems, apparatuses, and methods. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

What is claimed is:

1. An electrical connector for sealing a differential pressure across a bulkhead, comprising:

a connector body having a first end, a second end, a length therebetween and an exterior surface, the connector body configured to be positioned in a port of the bulkhead;

a first electrical contact positioned at the first end of the connector body;

a second electrical contact positioned at the second end of the connector body and including a forward end or ring, a rear tail and at least one elongate contact element defining a cavity for receiving a male electrical contact of a mating connector and configured to flex away from the cavity, each elongate contact element of the at least one elongate contact element including a first end and a second end, the forward end or ring connected to the first end of the at least one elongate contact element and the rear tail connected to the second end of the at least one elongate contact element; and a conductor pin extending through the connector body along the length of the connector body and electrically connecting the first electrical contact to the second electrical contact, and the connector body having a sealed connection to at least one of the first electrical contact, the second electrical contact, or the conductor pin, for sealing a pressure differential across the bulkhead.

2. The electrical connector of claim 1, wherein the at least one elongate contact element forms a helical shape around the cavity.

3. The electrical connector of claim 1, wherein the at least one elongate contact element includes a plurality of elongate contact elements positioned in a hyperboloid configuration.

4. The electrical connector of claim 3, wherein the rear tail extends over the plurality of elongate contact elements at the second ends of the plurality of elongate contact elements to secure the plurality of elongate contact elements in the hyperboloid configuration.

5. The electrical connector of claim 1, wherein the rear tail is integral with the conductor pin.

6. The electrical connector of claim 1, wherein the rear tail includes a cavity for receiving the conductor pin.

7. An electrical connector for sealing a differential pressure across a bulkhead, comprising:

a connector body having a first end, a second end and an exterior surface, the exterior surface including a groove that extends circumferentially around the connector body;

a first plurality of electrical contacts positioned at the first end of the connector body;

a second plurality of electrical contacts positioned at the second end of the connector body and including at least one elongate contact element configured to receive a male electrical contact of a mating connector, each elongate contact element of the at least one elongate contact element having a first end and a second end, a respective electrical contact of the second plurality of electrical contacts having a forward end or ring and a rear tail the forward end or ring connected to the first end of the at least one elongate contact element and the rear tail connected to the second end of the at least one elongate contact element; and a plurality of conductor pins that extend through the connector body, a respective conductor pin of the plurality of conductor pins electrically connecting a respective electrical contact of the first plurality of electrical contacts and a respective electrical contact of the second plurality of electrical contacts.

8. The electrical connector of claim 7, wherein the at least one elongate contact element defines a cavity and forms a helical shape around the cavity.

9. The electrical connector of claim 7, wherein the at least one elongate contact element includes a plurality of elongate contact elements positioned in a hyperboloid configuration.

10. The electrical connector of claim 9, wherein the rear tail extends over the plurality of elongate contact elements at the second ends of the plurality of elongate contact elements to secure the plurality of elongate contact elements in the hyperboloid configuration.

11. The electrical connector of claim 7, wherein the rear tail is integral with the respective conductor pin.

12. The electrical connector of claim 7, wherein the rear tail includes a cavity for receiving the respective conductor pin.

13. The electrical connector of claim 7, wherein the groove is configured to allow a sealing device to be positioned.

* * * * *